US006015027A

United States Patent [19]

Banks

[11] Patent Number: 6,015,027

[45] Date of Patent: Jan. 18, 2000

[54] ESCAPE LADDER ASSEMBLY

[76] Inventor: Frank Banks, 47 N Downs Crescent, New Addington, Croydon, Surrey CR0 0LG, United Kingdom

[21] Appl. No.: 09/307,351

[22] Filed: May 6, 1999

[51] Int. Cl.[7] ..... E06B 1/06

[52] U.S. Cl. ..... 182/70; 182/196

[58] Field of Search ..... 182/70, 196–7, 182/199, 73, 74

[56] References Cited

U.S. PATENT DOCUMENTS

| | | | |
|---|---|---|---|
| 433,061 | 7/1890 | Aarons | 182/76 |
| 3,677,366 | 7/1972 | Coellel | 182/70 |
| 4,127,184 | 11/1978 | Shrohmeyer | 182/196 |

FOREIGN PATENT DOCUMENTS

| | | | |
|---|---|---|---|
| 2238419 | 2/1974 | Germany | 182/196 |
| 43380 | 1/1938 | Netherlands | 182/196 |

*Primary Examiner*—Alvin Chin-Shue

[57] ABSTRACT

A escape ladder assembly for permitting a user to escape through a window of an upper story of a building. The escape ladder assembly includes a ladder having a spaced apart pair of elongate flexible members and a plurality of steps extending between the flexible members of the ladder. Each of the flexible members has opposite upper and lower ends. A storage box is provided having an opening therein and a lid substantially covering the opening of the storage box. The lid is detachably coupled to the storage box. The ladder is disposed in the storage box. The upper ends of the flexible member of the ladder are coupled to the storage box and the bottom ends of the flexible member are coupled to the lid.

6 Claims, 3 Drawing Sheets

ESCAPE LADDER ASSEMBLY

BACKGROUND OF THE INVENTION

1. Field of the Invention

The present invention relates to escape ladders and more particularly pertains to a new escape ladder assembly for permitting a user to escape through a window of an upper story of a building.

2. Description of the Prior Art

The use of escape ladders is known in the prior art. More specifically, escape ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,445,589; U.S. Pat. No. 2,990,908; U.S. Pat. No. 2,616,608; U.S. Pat. No. 4,852,688; U.S. Pat. No. 5,372,217; and U.S. Pat. No. Des. 370,736.

While these devices fulfill their respective, particular objectives and requirements, the aforementioned patents do not disclose a new escape ladder assembly. The inventive device includes a ladder having a spaced apart pair of elongate flexible members and a plurality of steps extending between the flexible members of the ladder. Each of the flexible members has opposite upper and lower ends. A storage box is provided having an opening therein and a lid substantially covering the opening of the storage box. The lid is detachably coupled to the storage box. The ladder is disposed in the storage box. The upper ends of the flexible member of the ladder are coupled to the storage box and the bottom ends of the flexible member are coupled to the lid.

In these respects, the escape ladder assembly according to the present invention substantially departs from the conventional concepts and designs of the prior art, and in so doing provides an apparatus primarily developed for the purpose of permitting a user to escape through a window of an upper story of a building.

SUMMARY OF THE INVENTION

In view of the foregoing disadvantages inherent in the known types of escape ladders now present in the prior art, the present invention provides a new escape ladder assembly construction wherein the same can be utilized for permitting a user to escape through a window of an upper story of a building.

The general purpose of the present invention, which will be described subsequently in greater detail, is to provide a new escape ladder assembly apparatus and method which has many of the advantages of the escape ladders mentioned heretofore and many novel features that result in a new escape ladder assembly which is not anticipated, rendered obvious, suggested, or even implied by any of the prior art escape ladders, either alone or in any combination thereof.

To attain this, the present invention generally comprises a ladder having a spaced apart pair of elongate flexible members and a plurality of steps extending between the flexible members of the ladder. Each of the flexible members has opposite upper and lower ends. A storage box is provided having an opening therein and a lid substantially covering the opening of the storage box. The lid is detachably coupled to the storage box. The ladder is disposed in the storage box. The upper ends of the flexible member of the ladder are coupled to the storage box and the bottom ends of the flexible member are coupled to the lid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new escape ladder assembly apparatus and method which has many of the advantages of the escape ladders mentioned heretofore and many novel features that result in a new escape ladder assembly which is not anticipated, rendered obvious, suggested, or even implied by any of the prior art escape ladders, either alone or in any combination thereof.

It is another object of the present invention to provide a new escape ladder assembly which may be easily and efficiently manufactured and marketed.

It is a further object of the present invention to provide a new escape ladder assembly which is of a durable and reliable construction.

An even further object of the present invention is to provide a new escape ladder assembly which is susceptible of a low cost of manufacture with regard to both materials and labor, and which accordingly is then susceptible of low prices of sale to the consuming public, thereby making such escape ladder assembly economically available to the buying public.

Still yet another object of the present invention is to provide a new escape ladder assembly which provides in the apparatuses and methods of the prior art some of the advantages thereof, while simultaneously overcoming some of the disadvantages normally associated therewith.

Still another object of the present invention is to provide a new escape ladder assembly for permitting a user to escape through a window of an upper story of a building.

Yet another object of the present invention is to provide a new escape ladder assembly which includes a ladder having a spaced apart pair of elongate flexible members and a plurality of steps extending between the flexible members of the ladder. Each of the flexible members has opposite upper and lower ends. A storage box is provided having an opening therein and a lid substantially covering the opening of the storage box. The lid is detachably coupled to the storage box. The ladder is disposed in the storage box. The upper ends of the flexible member of the ladder are coupled to the storage box and the bottom ends of the flexible member are coupled to the lid.

Still yet another object of the present invention is to provide a new escape ladder assembly that may also be used to permit escape from a balcony of an upper story of a building.

Even still another object of the present invention is to provide a new escape ladder assembly that is designed for compact storage before deployment so that the assembly is not too obtrusive in the living space where it is located.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
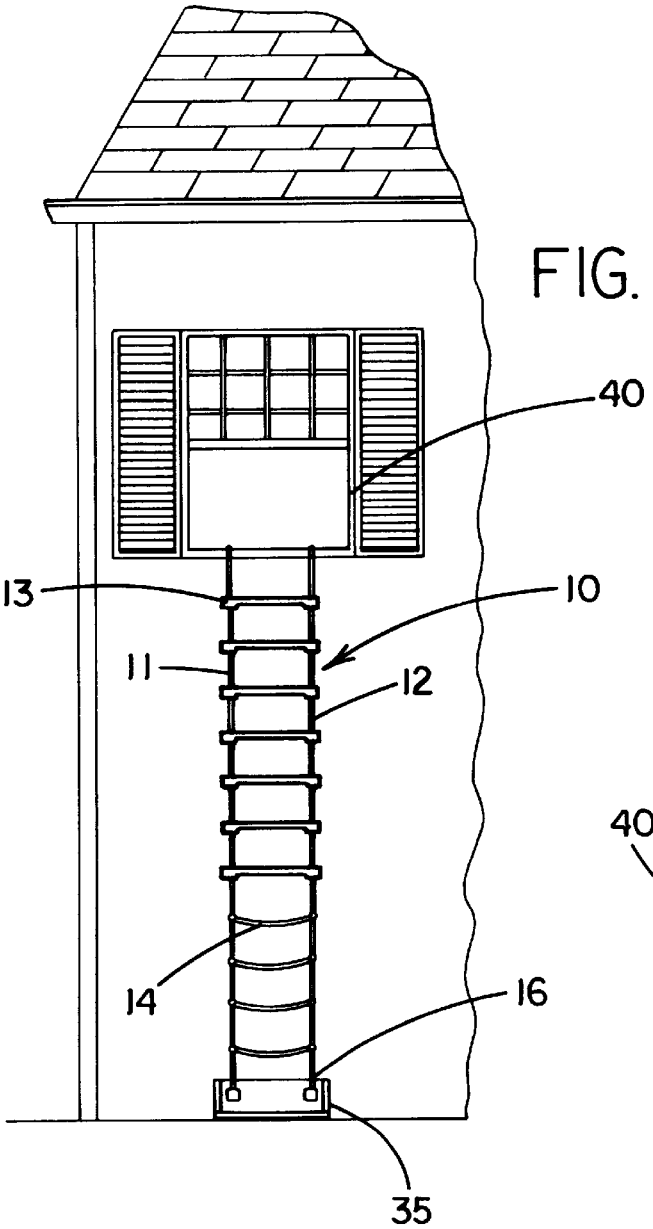
FIG. 1 is a schematic plan view of a new escape ladder assembly in use unfurled from a window of a building according to the present invention.

With reference now to the drawings, and in particular to FIGS. 1 through 6 thereof, a new escape ladder assembly embodying the principles and concepts of the present invention will be described.

As best illustrated in FIGS. 1 through 6, the escape ladder assembly generally comprises a ladder having a spaced apart pair of elongate flexible members and a plurality of steps extending between the flexible members of the ladder. Each of the flexible members has opposite upper and lower ends. A storage box is provided having an opening therein and a lid substantially covering the opening of the storage box. The lid is detachably coupled to the storage box. The ladder is disposed in the storage box. The upper ends of the flexible member of the ladder are coupled to the storage box and the bottom ends of the flexible member are coupled to the lid.

In closer detail, the escape ladder assembly comprises a rope ladder 10 having a spaced apart pair of elongate flexible members 11,12 and a plurality of steps 13,14 extending between the flexible members of the ladder. Preferably, the flexible members each comprise a length of flexible rope or cable or similar structure. Each of the flexible members has opposite upper and lower ends 15,16.

The plurality of steps comprises a plurality of stackable rigid steps 13 and a plurality of flexible steps 14. The rigid steps are arranged in a row extending along the flexible members positioned towards the upper ends of the flexible members. The flexible steps are arranged along the flexible members in a row extending along flexible members between the row of rigid steps and the lower ends of the flexible members. The flexible steps each comprise a flexible rope or cable of similar material as the flexible members.

Figure 3:
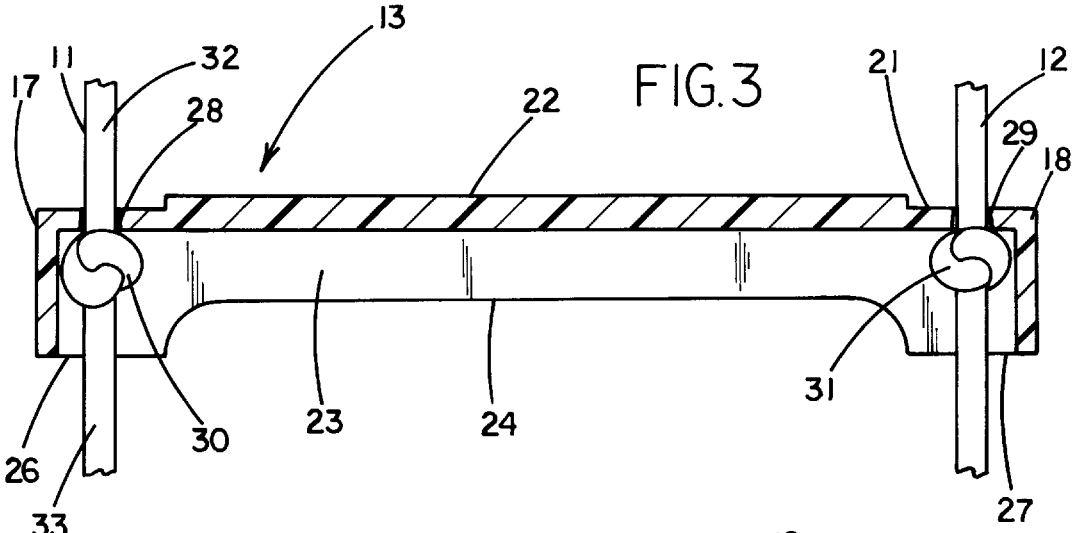
FIG. 3 is a schematic cross sectional view of a rigid step.
Figure 4:
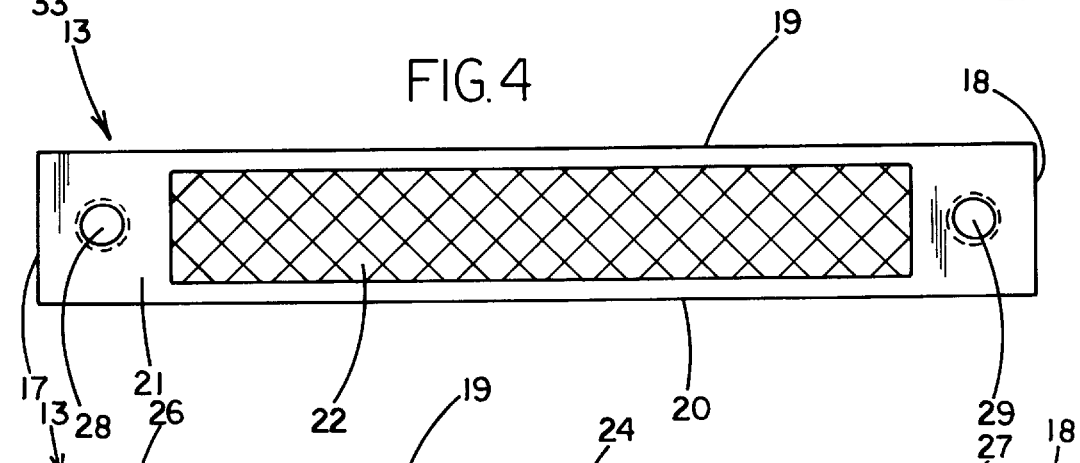
FIG. 4 is a schematic top plan view of a rigid step.
Figure 5:
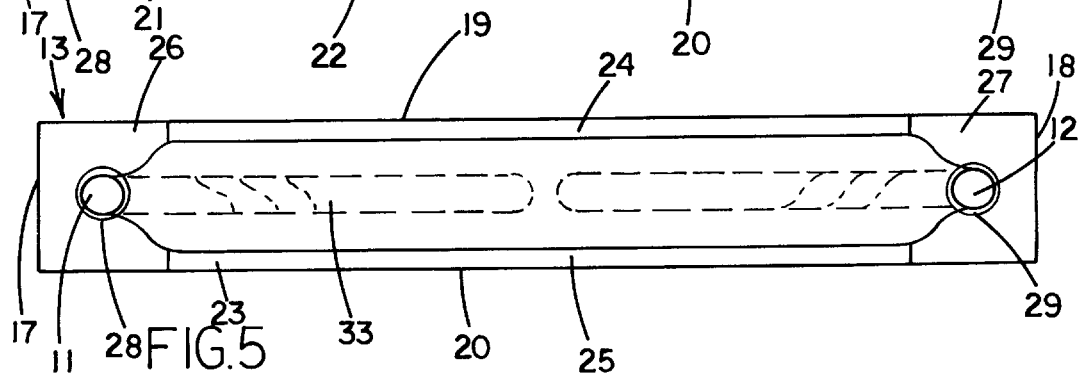
FIG. 5 is a schematic bottom view of a rigid step with the location where the adjacent segments of the flexible members are folded when the rigid steps are stacked in the storage box illustrated in phantom lines.

With particular reference to FIGS. 3, 4 and 5, each of the rigid steps 13 has an outer perimeter comprising a spaced apart pair of ends 17,18, and a pair of sides 19,20 extending between the ends of the respective rigid step. Each of the rigid steps preferably has an upper face 21 with a generally rectangular frictionally enhanced surface 22 with respective to a relatively smooth surface to frictionally enhance contact between the upper face of the respective rigid step and a foot of a user rigid stepping on the upper face and engaging the frictionally enhanced surface to help prevent a user from slipping on the respective rigid step.

Each of the rigid steps has a downwardly depending lower lip 23 extending around the outer perimeter of the respective rigid step. Preferably, the lower lip of each rigid step has a pair of side cutouts 24,25 therein with one of the side cutouts located adjacent one side of the respective rigid step and the other of the side cutouts located adjacent the other side of the respective rigid step. The side cutouts form a spaced apart pair of stacking feet 26,27 in the respective lower lip with one foot positioned adjacent one end of the respective rigid step and the other foot positioned adjacent the other end of the respective rigid step.

Each of the rigid steps has a spaced apart pair of generally circular holes 28,29 therethrough with one of the holes of each rigid step positioned adjacent one end of the respective rigid step and the other hole of each rigid step positioned adjacent the other end of the respective rigid step. A first of the flexible members is extended through a first of the holes of each of the rigid steps and a second of the flexible members is extended through a second of the holes of each of the rigid steps.

Figure 2:
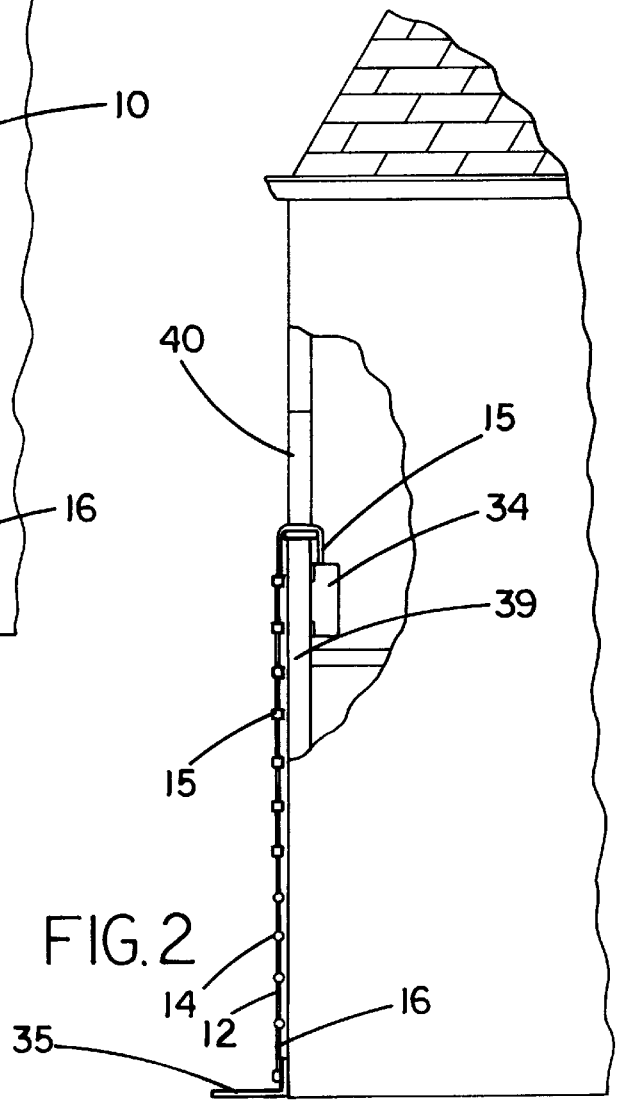
FIG. 2 is a schematic breakaway side view of the present invention in use unfurled from a window of a building.

The flexible members each have a plurality of knots 30,31 arranged in a spaced apart row along the respective flexible member. The rigid steps of the row of rigid steps alternate with the knots of the row of knots so that each rigid step has an associated knot of each flexible member positioned adjacent a bottom face of the respective rigid step. Each of the knots has a size greater than the corresponding holes of the associated rigid step to prevent passage of each knot through the corresponding hole. The pair of knots of the first and second flexible member associated with each rigid step is commonly aligned with one another such that when the ladder hangs in a deployed position, the knots lie in a common horizontal plane so that each rigid step is horizontal as illustrated in FIGS. 1 and 2.

The knots of each flexible member dividing the respective flexible member into a plurality of segments with a segment 32,33 is defined between adjacent knots of the respective flexible member.

Figure 6:
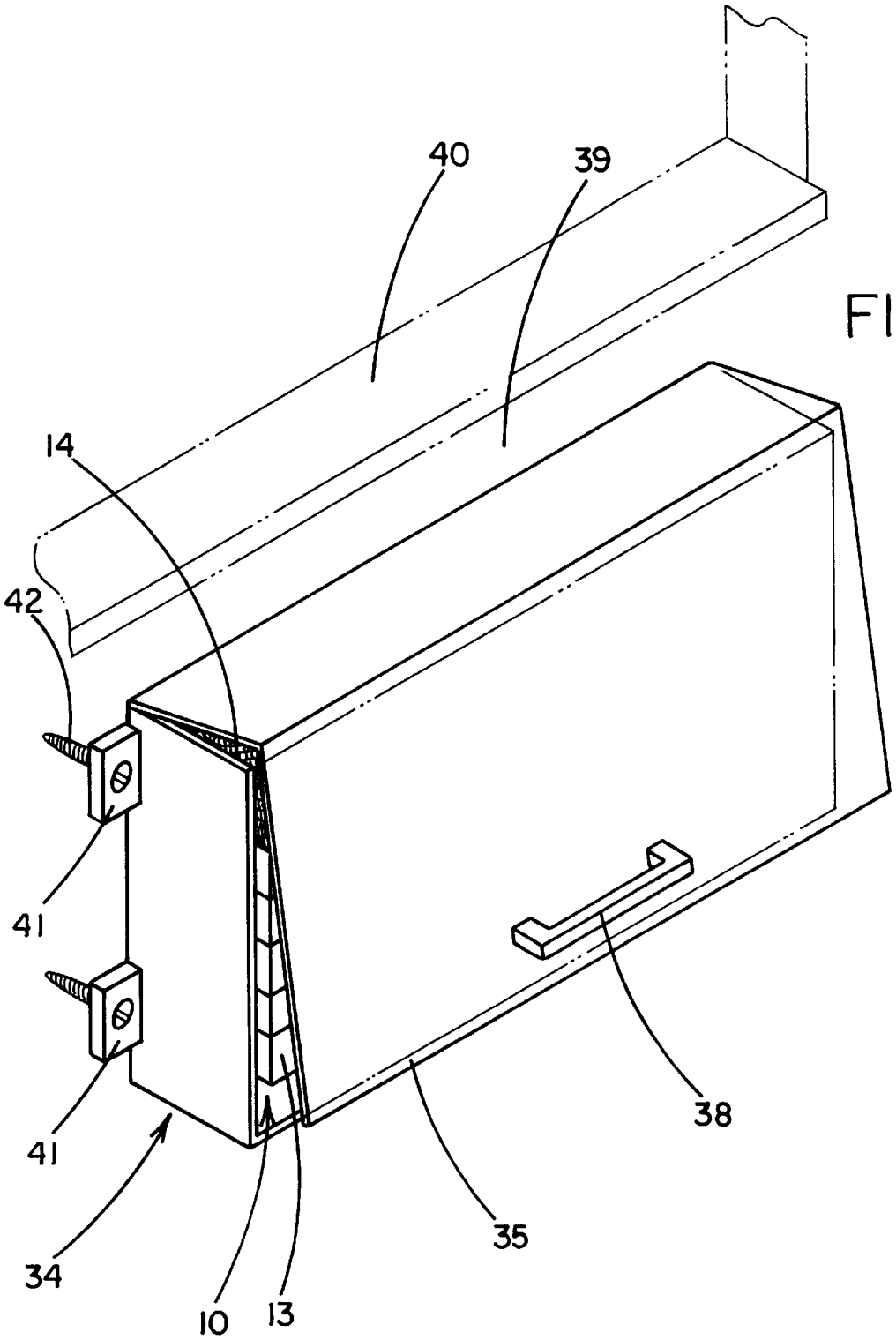
FIG. 6 is a schematic perspective view of the storage box.

With reference to FIG. 6, a generally rectangular storage box 34 is provided having a back, a bottom, a spaced apart pair of sides, an open top, an open front, and a lid 35 substantially covering the open top and front of the storage box. The lid preferably has a generally rectangular top and front portions 36,37 preferably pivotally coupled together. The top portion of the lid is detachably and also preferably pivotally coupled to the back of the storage box by an easy to break seal or hinge. The top portion of the lid covers the open top of the storage box while the front portion of the lid covers the open front of the storage box. Preferably, the front portion of the lid has a handle 38 for aiding opening and detachment of the lid from the storage box. The easy to break seal or hinge is included so that a user may easily determine whether the storage box has been previously tapered with when the ladder is in the storage box.

The back of the storage box is designed for mounting to a wall surface 39 beneath a window 40 of a building. Preferably, the back of the storage box has a plurality of mounting tabs 41 extending therefrom. Each of the mounting tabs is designed for extending a fastener 42 therethrough and into the wall surface to mount the back of the storage box to the wall surface.

The upper ends of the flexible member of the ladder are coupled to the storage box and the bottom ends of the flexible member are coupled to the lid. The ladder is disposed in the storage box with the rigid steps is stacked upon one another in the storage box. As best shown in FIG. 5, the segments of the flexible members are folded between the adjacent steps and positioned in a lower space defined by the lower lip of the upper one of the associated steps. The flexible steps and a corresponding remainder portion of each flexible member are folded and stacked on the stack of rigid steps in the storage container.

In use, the lid is lifted to break open the seal and open the storage box to expose the folded ladder in the storage box. The lid is also detached from the storage box so that the ladder may unfolded and thrown over the sill of the adjacent window so that the ladder unfurls downwards from the window to the ground with the row of rigid steps closer to the window than the row of flexible steps as illustrated in FIGS. 1 and 2. The coupling of the lid to the lower ends of the flexible members is designed for providing some weight at the lower ends of the flexible members to help the ladder unfold to its deployed position and rests on the ground when the ladder is fully deployed from the window.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An escape ladder assembly, comprising:

a ladder comprising a spaced apart pair of elongate flexible members and a plurality of steps extending between said flexible members of said ladder;

each of said flexible members having opposite upper and lower ends;

a storage box having an opening therein and a lid substantially covering said opening of said storage box, said lid being detachably coupled to said storage box;

said ladder being disposed in said storage box; and said upper ends of said flexible member of said ladder being coupled to said storage box, said bottom ends of said flexible member being coupled to said lid wherein said plurality of steps comprises a plurality of rigid steps and a plurality of flexible steps, wherein said rigid steps are arranged in a row extending along said flexible members positioned towards said upper ends of said flexible members, and wherein said flexible steps are arranged along said flexible members in a row extending along said flexible members between said row of rigid steps and said lower ends of said flexible members.

2. The escape ladder assembly of claim 1, wherein each of said rigid steps has an outer perimeter comprising a spaced apart pair of ends, and a pair of sides extending between the ends of the respective rigid step, wherein each of said rigid steps has a downwardly depending lower lip extending around said outer perimeter of the respective rigid step, and wherein each of said rigid steps has a spaced apart pair of generally circular holes therethrough, one of said holes of each rigid step being positioned adjacent one end of the respective rigid step and the other of said holes of each rigid step being positioned adjacent the other end of the respective rigid step, a first of said flexible members being extended through a first of said holes of each of said rigid steps, a second of said flexible members being extended through a second of said holes of each of said rigid steps.

3. The escape ladder assembly of claim 2, wherein said flexible members each have a plurality of knots arranged in a spaced apart row along the respective flexible member, and wherein said rigid steps of said row of rigid steps alternate with said knots of said row of knots so that each rigid step has an associated knot of each flexible member positioned adjacent a bottom face of the respective rigid step, each of said knots having a size greater than the corresponding holes of the associated rigid step to prevent passage of each knot through the corresponding hole.

4. The escape ladder assembly of claim 1, wherein each of said rigid steps has an upper face having a frictionally enhanced surface with respective to a relatively smooth surface.

5. The escape ladder of claim 2, wherein said lower lip of each rigid step has a pair of side cutouts therein, one of said side cutouts being located adjacent one side of the respective rigid step and the other of said side cutouts being located adjacent the other side of the respective rigid step.

6. An escape ladder assembly system, comprising:

a ladder comprising a spaced apart pair of elongate flexible members and a plurality of steps extending between said flexible members of said ladder;

each of said flexible members having opposite upper and lower ends;

said plurality of steps comprising a plurality of rigid steps and a plurality of flexible steps;

said rigid steps being arranged in a row extending along said flexible members positioned towards said upper ends of said flexible members;

said flexible steps being arranged along said flexible members in a row extending along flexible members between said row of rigid steps and said lower ends of said flexible members;

each of said rigid steps having an outer perimeter comprising a spaced apart pair of ends, and a pair of sides extending between the ends of the respective rigid step;

each of said rigid steps having an upper face having a frictionally enhanced surface with respective to a relatively smooth surface;

each of said rigid steps having a downwardly depending lower lip extending around said outer perimeter of the respective rigid step, said lower lip of each rigid step having a pair of side cutouts therein, one of said side cutouts being located adjacent one side of the respective rigid step and the other of said side cutouts being located adjacent the other side of the respective rigid step;

said side cutouts forming a spaced apart feet in the respective lower lip, one of said feet being positioned adjacent one end of the respective rigid step and the other of said feet being positioned adjacent the other end of the respective rigid step;

each of said rigid steps having a spaced apart pair of generally circular holes therethrough, one of said holes of each rigid step being positioned adjacent one end of the respective rigid step and the other of said holes of each rigid step being positioned adjacent the other end of the respective rigid step;

a first of said flexible members being extended through a first of said holes of each of said rigid steps, a second of said flexible members being extended through a second of said holes of each of said rigid steps;

said flexible members each having a plurality of knots arranged in a spaced apart row along the respective flexible member;

said rigid steps of said row of rigid steps alternating with said knots of said row of knots so that each rigid step has an associated knot of each flexible member positioned adjacent a bottom face of the respective rigid step, each of said knots having a size greater than the corresponding holes of the associated rigid step to prevent passage of each knot through the corresponding hole;

said knots of each flexible member dividing the respective flexible member into a plurality of segments with a segment being defined between adjacent knots of the respective flexible member;

a generally rectangular storage box having a back, a bottom, a spaced apart pair of sides, an open top, an open front, and a lid substantially covering said open top and front of said storage box;

said lid having a generally rectangular top and front portions pivotally coupled together, said top portion of said lid being detachably coupled to said back of said storage box, said top portion of said lid covering said open top of said storage box, said front portion of said lid covering said open front of said storage box, said front portion of said lid having a handle;

said back of said storage box being adapted for mounting to a wall surface beneath a window of a building, wherein said back of said storage box has a plurality of mounting tabs extending therefrom, each of said mounting tabs being adapted for extending a fastener therethrough and into the wall surface to mount said back of said storage box to the wall surface;

said upper ends of said flexible member of said ladder being coupled to said storage box, said bottom ends of said flexible member being coupled to said lid; and said ladder being disposed in said storage box, said rigid steps being stacked upon one another in said storage box, said segments of said flexible members being folded between the adjacent steps and positioned in a lower space defined by said lower lip of one of the associated steps, said flexible steps and a corresponding remainder portion of each flexible member being folded and stacked on said stack of rigid steps in said storage container.

* * * * *